US006562529B1

(12) United States Patent
Kojima et al.

(10) Patent No.: US 6,562,529 B1
(45) Date of Patent: May 13, 2003

(54) ELECTROPHOTOGRAPHIC DRUM-SHAPED PHOTOCONDUCTOR AND IMAGE FORMING METHOD AND APPARATUS USING THE SAME

(75) Inventors: Narihito Kojima, Shizuoka (JP); Ryuta Takeichi, Kanagawa (JP); Akiyo Nakajima, Kanagawa (JP); Hiroshi Nagame, Shizuoka (JP); Yohta Sakon, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/545,454

(22) Filed: Apr. 7, 2000

(30) Foreign Application Priority Data

Apr. 8, 1999 (JP) ..... 11-100773

(51) Int. Cl.[7] ..... G03G 5/147; G03G 15/00

(52) U.S. Cl. ..... 430/56; 430/66; 430/132; 430/58.05; 399/174; 399/176; 399/308; 399/296; 399/347; 399/346

(58) Field of Search ..... 399/346, 347, 399/296, 174, 176, 308; 430/56, 66, 58.05, 133, 132

(56) References Cited

U.S. PATENT DOCUMENTS

| | | | | |
|---|---|---|---|---|
| 4,957,839 A | | 9/1990 | Rokutanzono et al. | |
| 5,008,172 A | | 4/1991 | Rokutanzono et al. | |
| 5,059,502 A | | 10/1991 | Kojima et al. | |
| 5,147,751 A | | 9/1992 | Kojima et al. | |
| 5,390,015 A | | 2/1995 | Nagame et al. | |
| 5,452,061 A | | 9/1995 | Kojima et al. | |
| 5,463,455 A | * | 10/1995 | Pozniakas et al. | 399/350 |
| 5,525,447 A | | 6/1996 | Ikuno et al. | |
| 5,540,815 A | | 7/1996 | Igarashi et al. | |
| 5,656,406 A | | 8/1997 | Ikuno et al. | |
| 5,840,455 A | | 11/1998 | Ikuno et al. | |
| 5,870,657 A | | 2/1999 | Nagame et al. | |
| 5,871,876 A | | 2/1999 | Ikuno et al. | |
| 6,014,532 A | | 1/2000 | Takeichi et al. | |
| 6,022,659 A | * | 2/2000 | Kanbayashi et al. | 430/106 |
| 6,030,733 A | | 2/2000 | Kami et al. | |
| 6,060,205 A | | 5/2000 | Takeichi et al. | |
| 6,063,532 A | * | 5/2000 | Miyake | 430/56 |
| 6,118,964 A | * | 9/2000 | Lojima et al. | 399/174 |
| 6,157,468 A | * | 12/2000 | Tsai et al. | 358/488 |
| 6,160,977 A | * | 12/2000 | Takeichi et al. | 399/127 |
| 6,163,669 A | | 12/2000 | Aoki et al. | |

OTHER PUBLICATIONS

Borsenbeger, Paul M. et al. Organic Photoreceptors for Imaging Systems. New York: Marcel–Dekker, Inc. pp. 6–17, 289–293. (1993).*

Diamond, Arthur S. Handbook of Imaging Materials. New York: Marcel–Dekker, Inc. p. 169. (1991).*

* cited by examiner

*Primary Examiner*—Christopher Rodee
(74) *Attorney, Agent, or Firm*—Oblon, Spivak, McClelland, Maier & Neustadt, P.C.

(57) ABSTRACT

An electrophotographic drum-shaped photoconductor has an electroconductive support and a photoconductive layer formed thereon, with a lubricating material being applied to the surface thereof in the shape of a plurality of bands spaced therebetween, constituting band-shaped lubricating material applied areas, extending along a circumference of the drum-shaped photoconductor in the direction perpendicular or substantially perpendicular to an axis of rotation of the drum-shaped photoconductor. An electrophotographic image formation method and an image forming apparatus employing the above-mentioned drum-shaped photoconductor are also disclosed.

12 Claims, 5 Drawing Sheets

ELECTROPHOTOGRAPHIC DRUM-SHAPED PHOTOCONDUCTOR AND IMAGE FORMING METHOD AND APPARATUS USING THE SAME

BACKGROUND OF THE INVENTION

1. Field of the Invention

The present invention relates to an electrophotographic photoconductor, and more particularly to an electrophotographic drum-shaped photoconductor with improved mechanical durability. The present invention also relates to an image forming method and apparatus using the above-mentioned electrophotographic drum-shaped photoconductor. The present invention is applicable to a copying machine, facsimile machine, laser printer, and direct digital printing master making apparatus.

2. Discussion of Background

The electrophotographic process using an electrophotographic photoconductor, which is utilized in the copying machine, facsimile machine, laser printer, and direct digital printing master making apparatus, includes at least the steps of uniformly charging the surface of the photoconductor, exposing the charged surface of the photoconductor to light images to form latent electrostatic images thereon, developing the latent electrostatic images with a developer to visible images, transferring the visible images to a transfer sheet, fixing the images to the transfer sheet, and cleaning the surface of the photoconductor.

In line with the trend toward the personal use of copying machine, facsimile machine, and laser printer, there is an increasing demand for improvement of durability of such electrophotographic apparatus so as to be free of maintenance, and improvement of stability of the obtained image quality.

Organic photoconductors are now widely used in the electrophotographic process because of various advantages over other photoconductors, for example, because of low manufacturing cost, high degree of freedom in the designing of the photoconductor, and no pollution problems.

There are conventionally known an organic photoconductor comprising a photoconductive resin such as polyvinylcarbazole (PVK); an organic photoconductor comprising a charge transport complex material such as polyvinyl carbazole (PVK)-2,4,7-trinitrofluorenone (TNF); a pigment-dispersed type photoconductor comprising a binder agent and a pigment such as phthalocyanine; and a function-separating photoconductor comprising a charge generation material and a charge transport material in combination. Of these conventional organic photoconductors, special attention is paid to the function-separating photoconductor.

The mechanism for formation of latent electrostatic images on the function-separating photoconductor is as follows. When the photoconductor is uniformly charged, and then exposed to light images, the light passes through a transparent charge transport layer and is absorbed by a charge generation material in a charge generation layer. The charge generation material generates charge carriers after light absorption. The charge carriers thus generated are injected into the charge transport layer and are transported in the charge transport layer in accordance with an electric field which is generated by charging. When the charges on the surface of the photoconductor are neutralized, latent electrostatic images are formed on the surface of the photoconductor.

In the function-separating photoconductor, it is conventionally known and considered to be effective to use in combination (a) a charge transport material which exhibits main light absorption in the ultraviolet region and (b) a charge generation material which exhibits main light absorption in the visible region. Such a function-separating photoconductor is widely used in various image forming apparatus.

Most of the charge transport materials that have been developed are low-molecular weight compounds. Such low-molecular weight compounds, however, do not exhibit film-forming properties when used alone, so that the low-molecular weight compounds are usually used in the form of a dispersion or a mixture with an inert polymer to prepare a charge transport layer. The thus prepared charge transport layer comprising the low-molecular weight charge transport material and the inert polymer is lacking in mechanical durability, and therefore has a shortcoming that the charge transport layer tends to be abraded in the course of repeated use in an electrophotographic process. The above-mentioned shortcoming of the charge transport layer becomes a serious problem because there is a keen demand for the improvement of the durability of electrophotographic engine. The demand for a function-separating photoconductor with high mechanical durability is remarkably increasing.

One of the key factors that impair the life of the organic photoconductor for use with the electrophotographic process is mechanical abrasion of the photoconductive layer.

To be more specific, when the photoconductive layer of the photoconductor is abraded, the electric characteristics of the photoconductor, such as charging performance and light decay performance, are changed, and consequently a predetermined image forming process cannot be carried out. The result is that the desired image quality in hard copies cannot be maintained.

The abrasion of the photoconductive layer may occur wherever the photoconductor comes in contact with other image formation units disposed around the photoconductor. However, a particular attention must be paid to a cleaning unit, such as a cleaning blade or cleaning brush, for physically removing remaining toner from the surface of the photoconductor. Other units may abrade the surface of the photoconductive layer, but will not have any substantial effect on the actual life of the photoconductor.

The method for maintaining a low coefficient of friction on the surface of the photoconductor is roughly divided into two groups. One is to internally add a lubricating material to the photoconductive layer, or a protective layer when provided the photoconductive layer; and the other is to externally supply the lubricating material to the surface of the photoconductor so that the lubricating material is retained thereon. The latter proved to be more advantageous than the former in order to maintain high mechanical durability for an extended period of time. For example, according to Japanese Laid-Open Patent Application 6-83097, the surface top layer of the photoconductor contains a fluorine-containing resin. In this case, the atomic ratio of carbon atom to fluorine atom in the surface top layer is specified through the analysis of X-ray photoelectron spectroscope (XPS), or the analysis of the contact angle of pure water with the surface of the photoconductor. In this application, the lubricating material is internally added to the surface top layer of the photoconductor. This method can produce an effect of maintaining the performance of the photoconductor for a short period of time, more specifically, while making of several ten thousands of copies. However, the above-mentioned photoconductor cannot stand a long-term operation of making of several hundred thousands of copies. Namely, it is impossible to continue the copying operation until the limit of durability of the image forming apparatus itself.

On the other hand, the method of continuously supplying a lubricating material to the surface of the photoconductor is also conventionally known. For instance, there is provided a lubricating and abrasion member for eliminating the contaminant from the surface of the photoconductor and keeping the good condition of the surface of the photoconductor, as disclosed in Japanese Laid-Open Patent Application 56-51767. According to this application, abrasion of the photoconductor and supply of the lubricating material thereto are alternately carried out since a lubricating material and an abrasive material are alternately formed on the member.

In Japanese Laid-Open Patent Application 56-113183, a lubricant supplying member in a rotatable cylindrical form, which retains a lubricating material thereon is brought into contact with the surface of the photoconductor to supply the surface of the photoconductor with the lubricating material.

It is proposed in Japanese Laid-Open Patent Application 58-115468 that a step of coating a nonvolatile liquid such as a silicone oil on the surface of the photoconductor be provided in contact with the photoconductor prior or posterior to the step of cleaning the photoconductor using a cleaning blade that also comes in contact therewith. For example, a silicone rubber roller or blade impregnated with a silicone oil is used as a member for carrying out the above-mentioned coating step.

Japanese Laid-Open Patent Application 6-342236 describes that a lubricating material such as zinc stearate is supplied to the surface of an image bearing member such as a photoconductor via a charging roller.

In Japanese Laid-Open Patent Application 8-202226, it is proposed to supply a lubricating material such as zinc stearate to the surface of an image bearing member such as a photoconductor via a brush as controlling the coating amount of lubricating material.

It has thus become possible to maintain a low friction coefficient of the surface of the photoconductor for an extended period of time. However, when the coefficient of surface friction is excessively decreased in order to reduce the abrasion of the photoconductor, some side effects are produced. To be more specific, it is confirmed that the developing performance on the surface of the photoconductor is lowered so that the image density of the obtained image becomes insufficient, and abnormal images such as image blurring occur.

SUMMARY OF THE INVENTION

Accordingly, it is a first object of the present invention to provide an electrophotographic photoconductor which can exhibit excellent mechanical durability, and produce high quality images stably.

A second object of the present invention is to provide an image formation method employing the above-mentioned electrophotographic photoconductor.

A third object of the present invention is to provide an image forming apparatus employing the above-mentioned electrophotographic photoconductor.

A fourth object of the present invention is to provide a method for applying a lubricating material to the surface of a drum-shaped photoconductor so as to eliminate the conventional shortcomings.

The above-mentioned first object of the present invention can be achieved by an electrophotographic drum-shaped photoconductor comprising an electroconductive support and a photoconductive layer formed thereon, with a lubricating material being applied to the surface thereof in the shape of a plurality of bands spaced therebetween, constituting band-shaped lubricating material applied areas, extending along a circumference of the drum-shaped photoconductor in the direction perpendicular or substantially perpendicular to an axis of rotation of the drum-shaped photoconductor.

It is preferable that the band-shaped lubricating material applied areas satisfy such a dimensional and positional relationship of $B/10<(A1+A2)<2B$ wherein A1 is the width of one of two adjacent band-shaped lubricating material applied areas, A2 is the width of the other band-shaped lubricating material applied area, and B is the distance between the center lines of the two adjacent band-shaped lubricating material applied areas in the direction of the circumference of the drum-shaped photoconductor.

The second object of the present invention can be achieved by an image formation method using an electrophotographic drum-shaped photoconductor comprising an electroconductive support and a photoconductive layer formed thereon, with a lubricating material being applied to the surface thereof in the shape of a plurality of bands spaced therebetween, constituting band-shaped lubricating material applied areas, extending along a circumference of the drum-shaped photoconductor in the direction perpendicular or substantially perpendicular to an axis of rotation of the drum-shaped photoconductor, the image formation method comprising the steps of uniformly charging the drum-shaped photoconductor, exposing the charged photoconducter to light images to form latent electrostatic images thereon, developing the latent electrostatic images to visible toner images using a developer, transferring the toner images to a transfer member, fixing the toner images onto the transfer sheet, and cleaning the surface of the drum-shaped photoconductor.

The third object of the present invention can be achieved by an image forming apparatus comprising an electrophotographic drum-shaped photoconductor which comprises an electroconductive support and a photoconductive layer formed thereon, with a lubricating material being applied to the surface thereof in the shape of a plurality of bands spaced therebetween, constituting band-shaped lubricating material applied areas, extending along a circumference of the drum-shaped photoconductor in the direction perpendicular or substantially perpendicular to an axis of rotation of the drum-shaped photoconductor; means for uniformly charging the drum-shaped photoconductor; means for exposing the charged photoconductor to light images to form latent electrostatic images thereon; means for developing the latent electrostatic images to visible toner images using a developer; means for transferring the toner images to a transfer member; means for fixing the toner images onto the transfer sheet; and means for cleaning the surface of the drum-shaped photoconductor.

The fourth object of the present invention can be achieved by a method for applying a lubricating material to the surface of an electrophotographic drum-shaped photoconductor for use in an electrophotographic image forming apparatus capable of producing toner images using a developer so that the lubricating material is applied to the surface thereof in the shape of a plurality of bands spaced therebetween, constituting band-shaped lubricating material applied areas, extending along a circumference of the drum-shaped photoconductor in the direction perpendicular or substantially perpendicular to an axis of rotation of the drum-shaped photoconductor.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The inventors of the present invention have intensively studied to solve the above-mentioned conventional problems in the electrophotographic process using the conventional organic photoconductor. As a result, it has been confirmed that excellent mechanical durability of the photoconductor can be obtained, and at the same time, high quality images can be produced for a long period of time by controlling the surface of the photoconductor where a lubricating material is deposited and retained thereon. Namely, an optimum value of the coefficient of surface friction of the photoconductor can be maintained for an extended period of time according to the present invention. Thus, the abrasion and wearing of the photoconductor can be minimized, and the life of the photoconductor can be maximized. When such an electrophotographic photoconductor is incorporated in an electrophotographic image forming apparatus, the image forming apparatus thus obtained causes no abnormal images such as image blurring, and produces high quality images with high image density.

The wearing of the photoconductor as caused by the cleaning unit can be classified into two main types. One is caused by a shearing force generated between the photoconductor and a cleaning blade or brush, and the other is caused by a toner which is held between the photoconductor and the blade or brush and works as a grinding stone to abrade the surface of the photoconductor.

The degree of wear of the photoconductor is determined by such factors as (a) the structural strength of the photoconductor., (b) the contact pressure between the photoconductor and the cleaning blade or brush, (c) the composition of toner particles, and (d) the surface friction coefficient of the photoconductor. In particular, there is a close correlation among the shear force generated at a contact portion of the photoconductor with the cleaning blade or brush, the surface friction coefficient of the photoconductor, and the abrasion wear of the photoconductor. It is found that when the abrasion wear of the photoconductor can be minimized by maintaining a small surface friction coefficient, thereby obtaining an image forming apparatus with excellent mechanical durability.

The present invention will now be explained in detail with reference to the figures.

Figure 1:
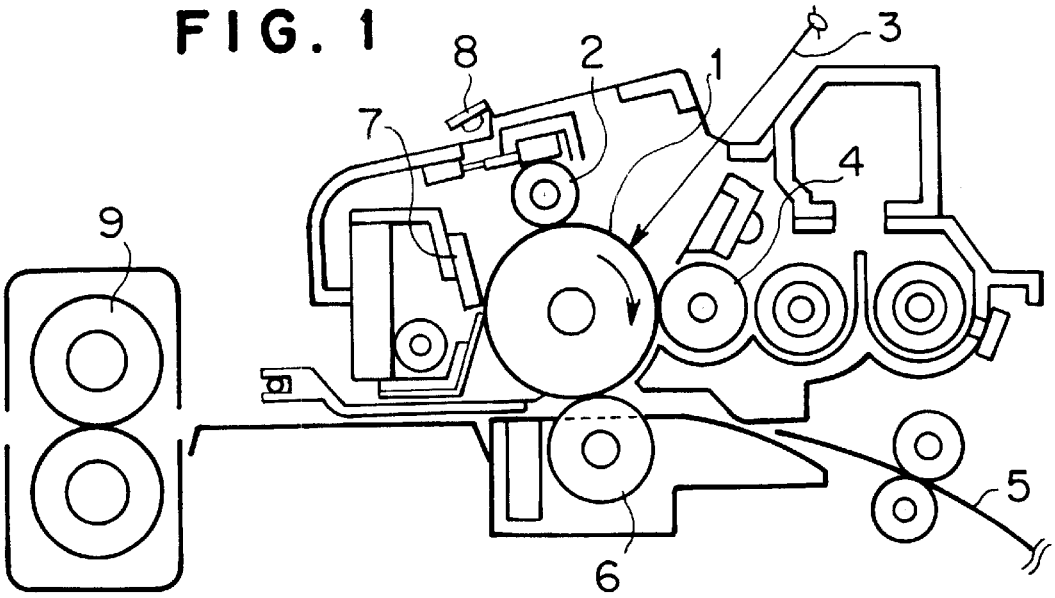
FIG. 1 is a schematic view which shows an example of an image forming apparatus according to the present invention.

FIG. 1 is a schematic cross-sectional view which shows an example of an image forming apparatus according to the present invention.

The image forming apparatus of FIG. 1 comprises a drum-shaped photoconductor 1 which is rotated in the direction of an arrow, around which there are disposed a charging unit 2, an image exposure means 3 of an exposure unit (not shown), a developing unit 4, an image transfer unit 6, a cleaning unit 7, and a quenching lamp 8. A transfer sheet 5 is transported to an image fixing unit 9 after the completion of image transfer.

According to the present invention, a lubricating material is applied to the surface of the drum-shaped photoconductor in the shape of a plurality of bands spaced therebetween, constituting band-shaped lubricating material applied areas, extending along a circumference of the drum-shaped photoconductor in the direction perpendicular on substantially perpendicular to an axis of rotation of the drum-shaped photoconductor.

FIG. 3 through FIG. 6 are schematic views which show embodiments of the means for supplying the lubricating material to the surface of the drum-shaped photoconductor.

Figure 3:
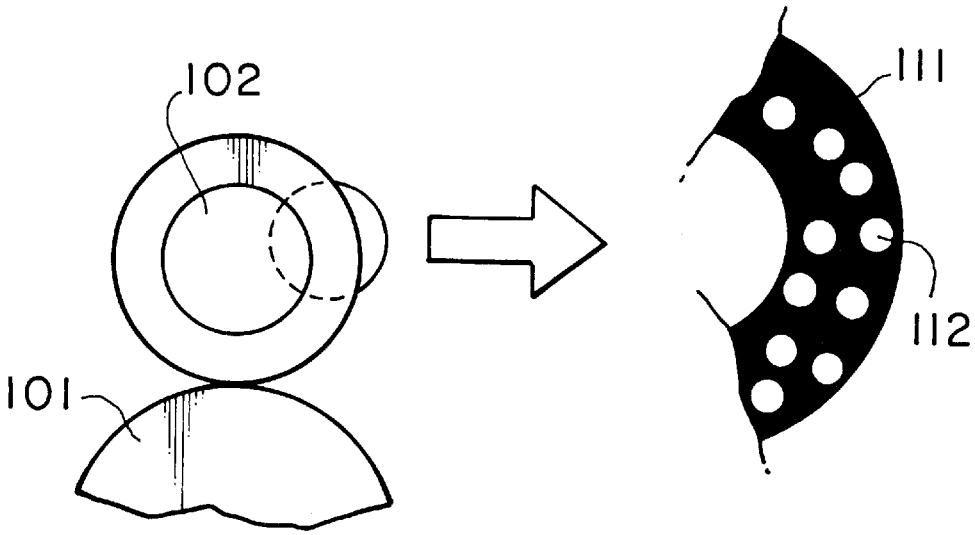
FIG. 3 is a schematic cross-sectional view which shows an example of the unit for supplying a lubricating material to the surface of a photoconductor according to the present invention.

In FIG. 3, a contact type charging unit 102 in the form of a roller can serve as the means for supplying a lubricating material to the surface of a drum-shaped photoconductor 101. In such a case, the charging roller 102 can be prepared by kneading particles of lubricating material 112 in a functional material 111 for voltage application, as shown in a fragmentary sectional view.

Figure 4:
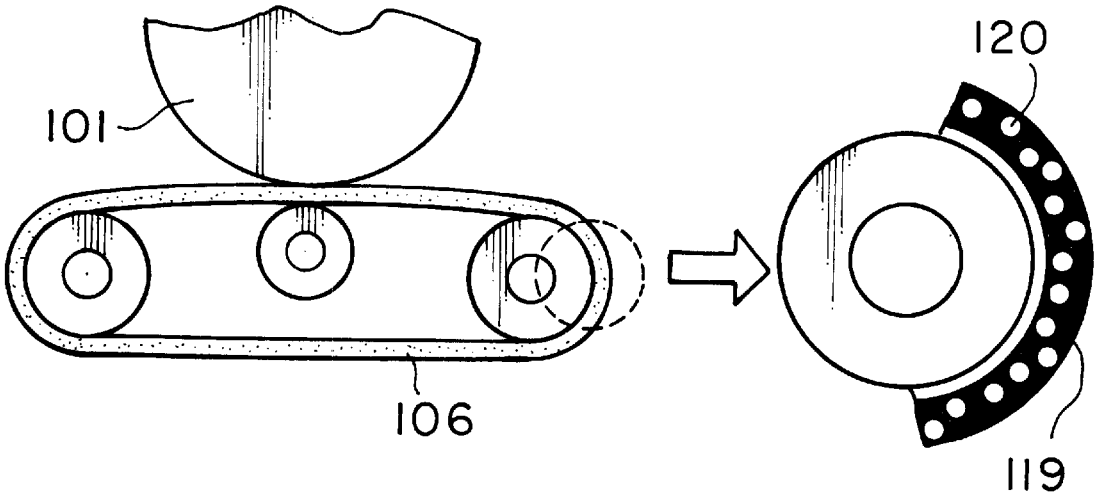
FIG. 4 is a schematic cross-sectional view which shows another example of the unit for supplying a lubricating material to the surface of a photoconductor according to the present invention.

In FIG. 4, an image transfer unit 106 in the form of a belt can supply a lubricating material to the surface of a drum-shaped photoconductor 101. In the case of FIG. 4, particles of lubricating material 120 is contained in a functional material 119 for voltage application to prepare the image transfer belt 106. More specifically, while an electroconductive elastic material such as carbon is dispersed in an elastomer to form the voltage-application functional material 111 (or 119), the lubricating material 112 (or 120) may be kneaded therein.

Figure 5:
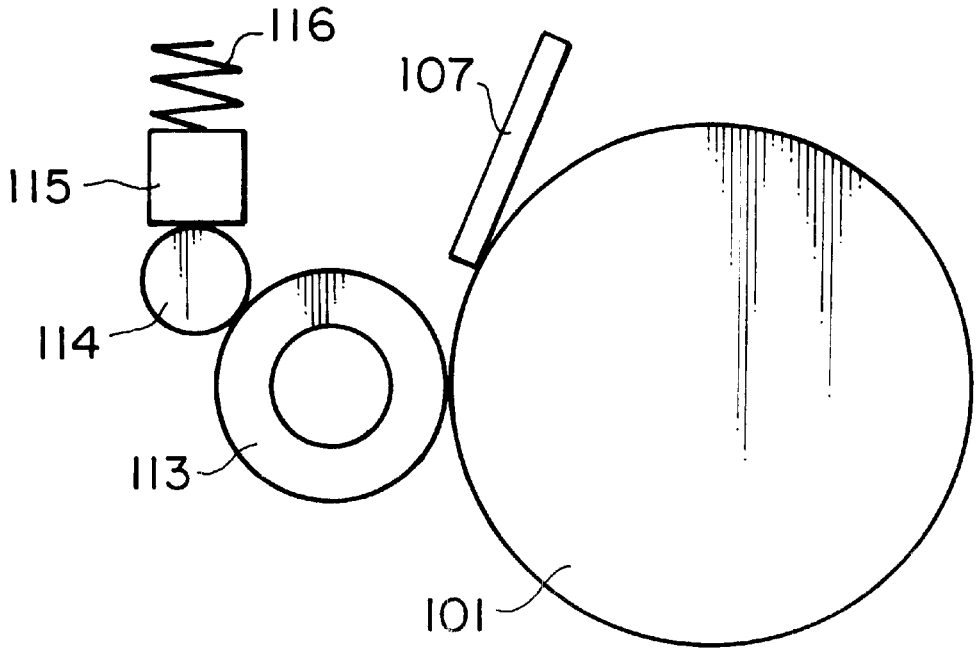
FIG. 5 is a schematic cross-sectional view which shows a still another example of the unit for supplying a lubricating material to the surface of a photoconductor according to the present invention.

Similarly, a lubricating material can be supplied to the surface of a drum-shaped photoconductor 101 using a cleaning roll-shaped brush 113 as shown in FIG. 5. In FIG. 5, reference numeral 114 indicates a lubricating material replenishing roller, reference numeral 115 indicates a lubricating material; reference numeral 116 indicates a spring; and reference numeral 107 indicates a cleaning blade.

Figure 6:
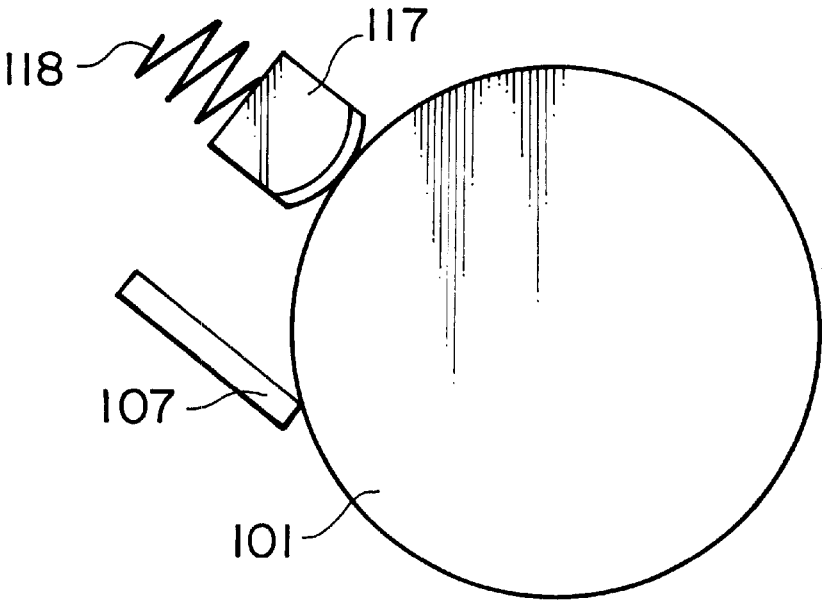
FIG. 6 is a schematic cross-sectional view which shows a further example of the unit for supplying a lubricating material to the surface of a photoconductor according to the present invention.

Furthermore, as shown in FIG. 6, there is independently disposed a member 127 for supplying a lubricating material to the surface of a drum-shaped photoconductor 101. The above-mentioned member 117 is hereinafter referred to as a lubricant supplying member. In FIG. 6, reference numeral 107 indicates a cleaning blade; and reference numeral 118 indicates a spring.

It is important that the lubricant supplying member 117 be softly and surely in contact with the surface of the surface of the drum-shaped photoconductor 101. Therefore, the lubricant supplying member 117 may have an elastic structure. For example, it is preferable to employ a material with a network structure, a sponge-like material prepared by blowing air bubbles into the gap of fibers, a marshmallow-like material, and a material prepared by softly making up the fibers into a bundle that tears easily in a longer direction thereof. There are commercially available products, for example, "Teflon soft tape" (Trademark), made by FLON INDUSTRY Co., Ltd.; and "NAFLON PTFE SP PACKING" (Tracemark), made by Nichias Corporation.

The thickness of the lubricant supplying member 117 is a significant factor to determine the contact conditions between the lubricant supplying member 117 and the drum-shaped photoconductor 101. When the lubricant supplying member 117 is too thin, the durability of the member 117 is lowered. On the other hand, when the lubricant supplying member 117 is excessively thick, the lubricant supplying member 117 cannot flexibly come in contact with the photoconductor 101, thereby damaging the surface of the photoconductor 101. It is preferable that the thickness of the lubricant supplying member 117 be in the range of about 50 to 500 $\mu$m, more preferably in the range of about 100 to 300 $\mu$m.

When a flexible material is used for the lubricant supplying member, there is the advantage that stable contact between the lubricant supplying member and the photoconductor can be ensured. There are also the shortcomings that the lubricant supplying member, if the thickness thereof is insufficient, tends to become stretched or wrinkled to cause deformation, and to be easily broken when rubbed against the surface of the photoconductor. To make the best of the flexible material, the flexible material may be lined with other materials such as an acetate film when the lubricant supplying member is prepared.

A lubricating material can be singly disposed without any supporting member therefor as long as the hardness of the portion thereof connected to the image forming apparatus may be enhanced by selecting the kind of flexible material and molding process. However, in order to obtain stable performance and action in practice, it is effective that the lubricant supplying member be fixed to the supporting member or held between the supporting member and, a press plate.

As the supporting member for the lubricating material, a resin sheet and a metal plate are usable. For instance, a film made of resins such as polycarbonate resin, polyethylene-terephthalate resin, acrylic resin, and vinyl chloride resin, and a plate made of metals such as aluminum and stainless steel can be employed. Such a resin film or metal plate is also suitable for the above-mentioned press plate for the lubricating material. The thicknesses of the supporting member and the press plate may be appropriately determined in accordance with the structure of the lubricant supplying member.

Furthermore, the step of supplying the lubricating material to the surface of the photoconductor can be carried out simultaneously with the developing step. To be more specific, a container for a developer, such as a toner bottle, may be provided with not only a toner, but also a lubricating material so as to supply the lubricating material to the surface of the photoconductor simultaneously with the deposition of the toner on to the surface of the photoconductor.

The means for supplying the lubricating material to the photoconductor is not particularly limited to the embodiments as previously explained. The lubricant supplying means may be disposed so as to externally supply the lubricating material to the surface of the photoconductor.

The electrophotographic image forming apparatus according to the present invention will now be explained in detail.

The charging step and the image transfer step in the electrophotographic process can be classified into two methods, that is, a non-contact method and a contact method.

In the non-contact method, an electroconductive member in the form of a wire or a plate, such as a corona charger, is fixed out of contact with the photoconductor in parallel therewith, and a high voltage is applied to the electroconductive member to charge the photoconductor, whereby charging and image transfer are carried out. Of various conventional methods, this non-contact charging method is in most general use because uniform charging of the surface of the photoconductor can be obtained relatively easily.

In contrast to the above, the charging or image transfer step by the contact method is carried out in such a manner that a member provided with appropriate electroconductivity and elasticity, in the form of a brush, roller-shaped brush, blade, or belt is brought into contact with the surface of the photoconductor with the application of a voltage thereto, as disclosed in Japanese Laid-Open Patent Applications 63-149668 and 7-281503.

The contact charging or image transfer method is recently becoming very prevalent because the applied voltage required to conduct the charging or image transfer is lower than that required in the non-contact method, and the generation of ozone which is considered to be chemically harmful to the photoconductor and the human body is less in the course of the charging or image transfer step.

The image exposure means subsequent to the above-mentioned charging means may employ either analogue image exposure or digital image exposure. By the analogue image exposure, latent electrostatic images are formed on the photoconductor in such a manner that the photoconductor is exposed to a light image reflected by an original document via a lens or a mirror. On the other hand, in the digital image exposure, electrical signals output from a computer, or electric signals converted from image data obtained by reading an image on an original document with an image sensor such as a charge coupled device (CCD), are reproduced as a light image, using a laser beam or an LED array. The latter has become prevalent in recent years because of its advantages that a variety of processes are available and the obtained images are stable.

The latent electrostatic images thus formed on the photoconductor are developed to visible toner images by depositing a toner on the latent electrostatic images using the developing means. The developing means for use in the image forming apparatus according to the present invention can employ a conventional developer, such as a one-component developer, a two-component developer, or a liquid developer.

The toner images formed on the photoconductor are transferred to a transfer sheet such as a sheet of paper or a plastic film directly or through an intermediate image transfer medium. For the image transfer means, the corona charge- as employed in the above-mentioned charging means is also usable. Alternatively, the image transfer unit in the form of a roller, brush, or belt is brought into contact with the drum-shaped photoconductor.

After completion of the image transfer step, the toner remaining on the surface of the drum-shaped photoconductor is removed therefrom at the cleaning step. For example, the residual toner is squeezed from the photoconductor using a roller-shaped brush or an elastic blade. In recent years, there has appeared an image forming apparatus free of the above-mentioned cleaning means because the transferring efficiency of the developed toner image to the transfer sheet has progressed The means for supplying a lubricating material to the surface of the drum-shaped photoconductor in order to decrease the coefficient of surface friction of the photoconductor is roughly divided into two methods, that is, a direct method by which the lubricating material is directly applied to the surface of the photoconductor, and an indirect method by which the lubricating material is supplied thereto via another member.

Examples of the lubricating material for use in the present invention include liquid lubricating materials such as silicone oil and fluorine-containing oil; and solid or powder-like lubricating materials, such as a variety of fluorine-containing resins, for example, polytetrafluoroethylene (PTFE), ethylene tetrafluoride-perfluoroalkyl vinyl ether copolymer resin (PFA), and polyvinylidene fluoride (PVDF), silicone resin, polyolefin resin, silicone grease, fluorine-containing grease, paraffin wax, fatty esters, fatty acid metallic salts such as zinc stearate, graphite, and molybdenum dioxide.

The above-mentioned lubricating material may be supplied to the surface of the photoconductor by a proper method as mentioned above.

In particular, the lubricating material in a solid form or powder-like form is preferred because the state of the lubricating material deposited on the surface of the photoconductor can be maintained for a long period of time. When the lubricating material is a solid form, the solid material capable of retaining the original shape stably at room temperature (in the range of about 10 to 30° C.) is preferable to maintain the deposited state of the lubricating material for an extended period of time. With respect to the powder-like lubricating material, it is preferable that the particle size of the lubricating material be in the range of 0.01 to 100 $\mu$m. Even though such a powder-like lubricating material is stored in a toner tank together with a developer, the dispersion properties are satisfactory.

The necessity for controlling the deposited state of the lubricating material on the surface of the photoconductor will now be explained.

When the surface friction coefficient of the photoconductor is reduced in the above-mentioned manner, the abrasion wear of the photoconductor can be reduced. In particular, when the surface friction coefficient of the photoconductor, measured by the Euler-belt method, is controlled to be 0.4 or less, the abrasion of the photoconductor can be effectively prevented.

On the other hand, however, when the friction coefficient of the photoconductor is excessively reduced, the deposition force of toner particles on the surface of the photoconductor is lowered when the latent electrostatic images formed on the photoconductor are developed to visible toner images using a developing unit. As a result, toner particles cannot be transferred to a desired position on the photoconductor. Such an unfavorable phenomenon tends to easily occur in such a developing system where latent electrostatic images are developed with a two-component developer which comes into contact with the photoconductor. Namely, when the projected ear-shaped portions formed in the two-component developer are brought into contact with the surface of the photoconductor, there is the risk that the toner particles which have been already transferred to the right position on the surface of the photoconductor may be physically scraped off the photoconductor, or shifted to an improper position.

The above-mentioned unfavorable phenomenon scarcely occurs when the friction coefficient of the surface layer of the photoconductor is sufficiently high. When the surface friction coefficient of the photoconductor is decreased to less than 0.1, for example, about 0.05, the above-mentioned phenomenon noticeably occurs. This phenomenon becomes a fatal problem with respect to the quality of hard copy images. Therefore, it is important that the amount of lubricating material supplied to the surface of the photoconductor be controlled not to excessively reduce the surface friction coefficient of the photoconductor.

Furthermore, various materials are deposited on the surface of the photoconductor in the course of the electrophotographic process. Representative examples of such materials are oxidized gases such as ozone, Nox, and SOx, which are generated by a discharging process in a charging area or in an image transfer area, and ionic compounds which are produced by composite reactions of the above-mentioned oxidized gases. These compounds thus produced are so hydrophilic that the compounds tend to adsorb or trap water molecules in the air when the compounds are deposited on the surface of the photoconductor. The result is that the electric resistivity of the surface portion of the photoconductor is significantly decreased, so that the latent electrostatic images which are optically recorded on the surface of the photoconductor cannot retain the electric charges maintain required to the latent electrostatic images. Therefore, the latent electrostatic images cannot be retained on the photoconductor and are impaired.

In practice, however, the above-mentioned harmful materials which are deposited on the photoconductor are removed therefrom by use of a cleaning blade in the cleaning step, so that no serious problem comes about. However, when the friction coefficient of the photoconductor and that of the cleaning blade are excessively decreased, and the shear force generated between the photoconductor and the cleaning blade is excessively lowered, the deposited materials on the photoconductor cannot be easily removed therefrom by the cleaning blade. Thus, the deposited materials will bring about defective images.

Similar to the previously mentioned problem with respect to the developing performance, the above-mentioned problem resulting from insufficient cleaning becomes striking when the surface friction coefficient of the photoconductor is decreased to less than 0.1 when measured by the Euler-belt method.

To minimize the abrasion wear of the photoconductor, and to prevent the above-mentioned problems from happening, it becomes important to control the coating condition of the lubricating material on the photoconductor, that affects the surface friction coefficient of the photoconductor.

According to the present invention, the lubricating material is deposited and retained on the surface of the drum-shaped photoconductor in the shape of a plurality of bands spaced therebetween, constituting band-shaped lubricating material applied areas, extending along a circumference of the drum-shaped photoconductor in the direction perpendicular or substantially perpendicular to an axis of rotation of the drum-shaped photoconductor. Namely, the band-shaped lubricating material applied areas and band-shaped lubricating-material-free areas are alternately provided. It is preferable that the lubricating material applied area be Located at an angle of 90±10° with respect to the axis of rotation of the drum-shaped photoconductor.

Figure 2:
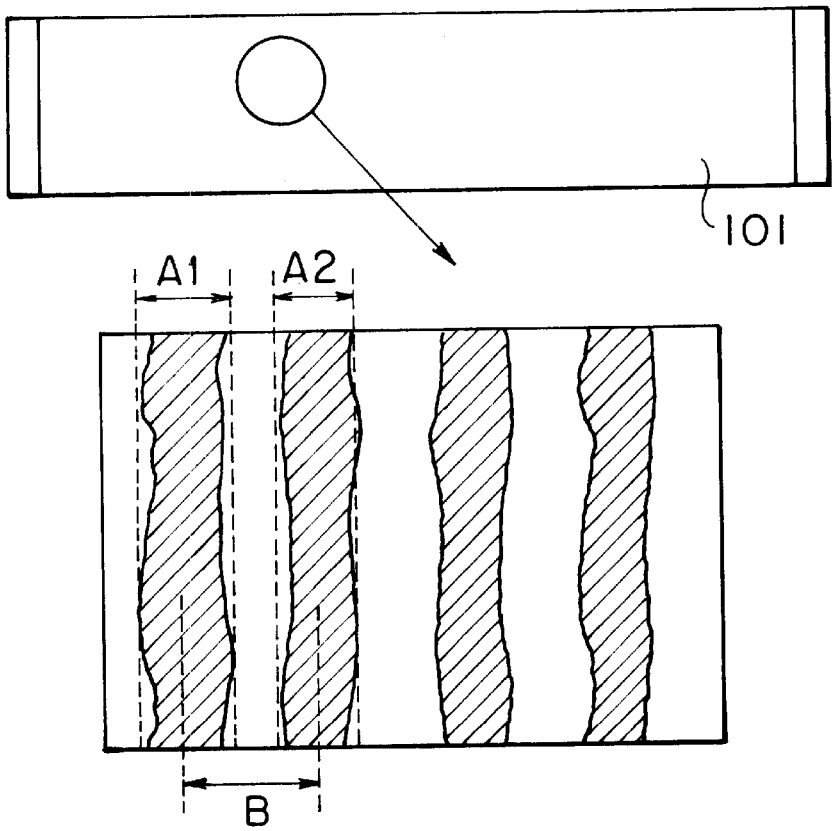
FIG. 2 is a schematic view which illustrates the state where a lubricating material is retained on the surface of a photoconductor according to the present invention.

Furthermore, with reference to FIG. 2, it is preferable that the band-shaped lubricating material applied areas and band-shaped lubricating-material-free areas be alternately provided and the band-shaped lubricating material applied areas satisfy such a dimensional and positional relationship of:

$$B/10<(A1+A2)<2B \quad (1)$$

wherein A1 is the width of one of two adjacent band-shaped lubricating material applied areas, A2 is the width of the other band-shaped lubricating material applied area, and B is the distance between the center lines of the two adjacent band-shaped lubricating material applied areas extending in the direction of the circumference of the drum-shaped photoconductor.

Further, in the above-mentioned formula (1), it is preferable that the distance B be more than 10 μm, and less than 500 μm. Namely, there may be such a relationship as represented by 10 μm<B<500 μm.

The above-mentioned formulas were experimentally obtained. The reason why desirable results can be obtained when the band-shaped lubricating material applied areas satisfy the above-mentioned dimensional and positional relationship is considered to be as follows.

When the entire surface of the drum-shaped photoconductor is uniformly coated with the lubricating material, the friction coefficient is excessively reduced so as to lower the adhesion of the toner to the photoconductor in the development step. The toner cannot be transferred to the photoconductor exactly. Furthermore, as mentioned above, oxidized gasses such as ozone, Nox, and SOx, and ionic compounds which are produced by composite reactions of the above-mentioned oxidized gases are deposited on the surface of the photoconductor. In the case where the friction coefficient of the photoconductor is excessively reduced, such compounds cannot be easily scraped off the photoconductor even by use of a cleaning blade. This will bring about defective images.

According to the present invention, the lubricating material is applied to the surface of the photoconductor in the shape of a plurality of bands spaced therebetween in the direction substantially perpendicular to the axis of rotation of the drum-shaped photoconductor. Namely, from a microscopic viewpoint, a slight distribution of the friction coefficient is formed on the surface of the drum-shaped photoconductor. Therefore, it becomes possible to minimize the decrease of the developing capability and the cleaning capability. The abrasion wear of the photoconductor can be decreased, and at the same time, the image quality of the produced toner images can be stabilized.

To obtain the drum-shaped photoconductor with a lubricating material being applied to the surface thereof in the above-mentioned shape, the following methods are effective.

For example, fine grooves are provided on the surface of the photoconductor so as to extend in the direction substantially perpendicular to the axis of rotation of the drum-shaped photoconductor, and a lubricating material is directly applied to the thus obtained surface of the photoconductor. Alternatively, a lubricating material is directly applied to the surface of the photoconductor using a lubricant supply member of which the surface has minute concave and convex portions. A lubricating material may be supplied to the surface of the photoconductor via a brush-shaped member.

As mentioned above, there is the necessity for controlling the state where the lubricating material is deposited on the surface of the drum-shaped photoconductor in order to provide a photoconductor system with minimum abrasion, and prevent the occurrence of abnormal images for an extended period of time.

In the present invention, the surface friction coefficient of the photoconductor is quantitatively measured by the Euler-belt method as mentioned above. The Euler-belt method will now be more specifically explained.

A sheet of high quality paper such as copy paper is cut into a belt-shaped paper tape with a predetermined width. The paper tape is brought into contact with the outer surface of a photoconductor drum so as to cover a ¼ peripheral portion of the outer surface of the photoconductor drum in such a configuration that the longitudinal direction of the paper tape is perpendicular to the lengthwise direction of the photoconductor drum. A load of 100 g is applied to one end portion of the paper tape which is directed perpendicularly, while the other end of the paper tape is attached to a tension gauge. Under such a condition that the load remains stationarily hanging from one end of the paper tape, the tension gauge is pulled at a constant speed. The scale of the tension gauge obtained when the paper tape starts to move is read. Then, the friction coefficient (μs) of the photoconductor drum is obtained in accordance with the following formula:

$$\mu s=2/\pi\times\ln(F/W)$$

wherein μs is a static friction coefficient, F (g) is a scale value of the tension gauge, and W is a weight (100 g) of the load.

The state of the lubricating material on the drum-shaped photoconductor can be confirmed by conventional methods, for example, by the observation using a scanning electron microscope (SEM), or by the mapping analysis of the elements that are present on the surface of the photoconductor using an X-ray photoelectron spectroscope (XPS).

The electrophotographic photoconductor according to the present invention will now be explained.

There can be employed an inorganic photoconductor comprising an electroconductive support and a photoconductive layer formed thereon comprising as the main component selenium or a selenium alloy, or a photoconductive layer comprising a binder agent and an inorganic photoconductive material such as zinc oxide or cadmium sulfide which is dispersed in the binder agent. In addition to the above, a photoconductor comprising amorphous silicon, and an organic photoconductor are also usable in the present invention.

Figure 7:
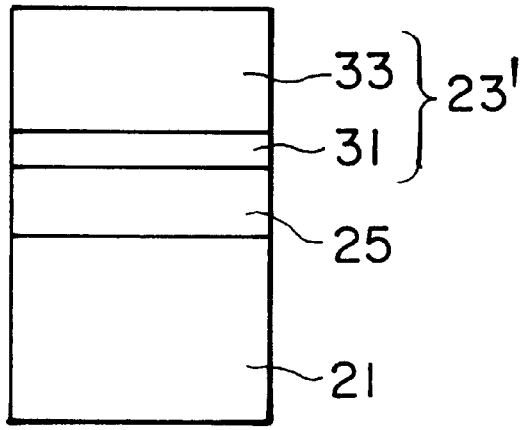
FIG. 7 is a schematic cross-sectional view which shows an example of an electrophotographic photoconductor according to the present invention.
Figure 8:
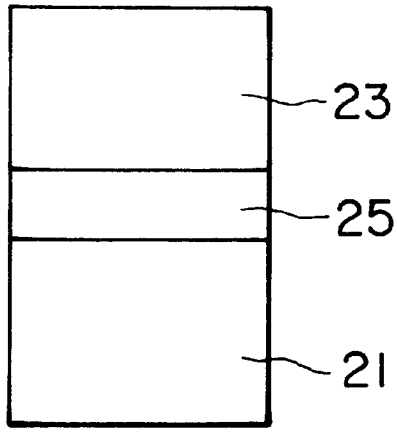
FIG. 8 is a schematic cross-sectional view which shows another example of an electrophotographic photoconductor according to the present invention.
Figure 9:
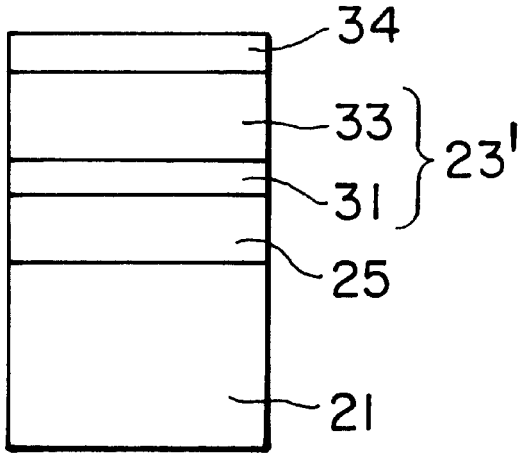
FIG. 9 is a schematic cross-sectional view which shows a still another example of an electrophotographic photoconductor according to the present invention.

FIG. 7 to FIG. 9 are schematic: cross-sectional views which show the structure of the electrophotographic photoconductor according to the present invention. As shown in FIG. 7, an undercoat layer 25, a charge generation layer 31, and a charge transport layer 33 are successively overlaid on an electroconductive support 21. A photoconductor of FIG. 8 comprises an electroconductive support 21, an undercoat layer 25 formed thereon, and a photoconductive layer 23 formed on the undercoat layer 25. In a photoconductor shown in FIG. 9, an undercoat layer 25, a charge generation layer 31, a charge transport layer 33, and a protective layer 34 are successively provided on an electroconductive support.

In FIG. 7 and FIG. 9, the charge generation layer 31 and the charge transport layer 33 constitutes a laminated photoconductive layer 23'. Further, the overlaying order of the charge generation layer 31 and the charge transport layer 33 may be reversed.

The electroconductive support 21 may exhibit electroconductive properties, for example, have a volume resistivity of $10^{10}$ Ω or less. The electroconductive support 21 can be prepared by coating metals such as aluminum, nickel, chromium, nichrome, copper, silver, gold, platinum, and iron, or metallic oxides such as tin oxide and indium oxide on a plastic film or a sheet of paper, which may be in the cylindrical form, by deposition or sputtering method. Alternatively, a plate of aluminum, aluminum alloys, nickel, or stainless steel may be formed into a tube by drawing and ironing (D.I.) method, impact ironing (I.I.) method, extrusion or pultrusion method. Subsequently, the tube thus obtained may be subjected to surface treatment such as cutting, superfinishing or abrasion to prepare the electroconductive support 21 for use in the drum-shaped photoconductor of the present invention.

The photoconductive layer may have a single-layered structure or a layered structure.

The layered photoconductive layer as shown in FIG. 7 and FIG. 9 comprises a charge generation layer 31 and a charge transport layer 33. The charge generation layer 31 will be first explained in detail.

The charge generation layer 31 comprises a charge generation material, optionally in combination with a binder resin. The charge generation material includes an inorganic material and an organic material.

Specific examples of the inorganic charge generation material are crystalline selenium, amorphous selenium, selenium-tellurium, selenium-tellurium-halogen, selenium-arsenic compound, and a-silicon (amorphous silicon). In particular, when the above-mentioned a-silicon is employed as the charge generation material, it is preferable that the dangling bond be terminated with hydrogen atom or a halogen atom, or be doped with boron atom or phosphorus atom.

Specific examples of the conventional organic charge generation materials for use in the present invention are phthalocyanine pigments such as metallo-phthalocyanine and metal-free phthalocyanine, azulenium salt pigments, squaric acid methyne pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryl oxadiazole skeleton, azo pigments having a distyryl carbazole skeleton, perylene pigments, anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoid pigments, and bisbenzimidazole pigments.

Those charge generation materials may be used alone or in combination.

Examples of the binder resin for use in the charge generation layer 31 are polyamide, polyurethane, epoxy resin, polyketone, polycarbonate, silicone resin, acrylic resin, poly(vinyl butyral), poly(vinyl formal), poly(vinyl ketone), polystyrene, poly-N-vinylcarbazole and polyacrylamide. Those binder resins may be used alone or in combination.

The charge generation layer 31 may further comprise a low-molecular charge transport material.

The above-mentioned low-molecular charge transport material includes a positive hole transport material and an electron transport material.

Examples of the electron transport material are conventional electron acceptor compounds such as chloroanil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, and 1,3,7-trinitrodibenzothiophene-5,5-dioxide. Those electron transport materials may be used alone or in combination.

Examples of the positive hole transport material include electron donor compounds such as oxazole derivatives, oxadiazole derivatives, imidazole derivatives, triphenylamine derivatives, 9-(p-diethylaminostyryl anthracene), 1,1-bis-(4-dibenzylaminophenyl)propane, styryl anthracene, styryl pyrazoline, phenylhydrazone, α-phenylstilbene derivatives, thiazole derivatives, triazole derivatives, phenazine derivatives, acridine derivatives, benzofuran derivatives, benzimidazole derivatives, and thiophene derivatives. Those positive hole transport materials may be used alone or in combination.

The charge generation layer 31 can be formed by vacuum thin-film forming method or casting method using a dispersion system.

The vacuum thin-film forming method includes vacuum deposition, glow discharge, ion plating, sputtering, reactive sputtering, and chemical vapor deposition (CVD). The above-mentioned inorganic and organic charge generation materials are applicable to the vacuum thin-film forming method.

When the charge generation layer 31 is formed by the casting method, the above-mentioned inorganic or organic charge generation material is dispersed in a proper solvent such as tetrahydrofuran, cyclohexanone, dioxane, dichloroethane, or butanone, optionally in combination with a binder agent, in a ball mill, an attritor or a sand mill. The dispersion thus obtained may be appropriately diluted to prepare a coating liquid for the charge generation layer 31. The coating of the coating liquid for the charge generation layer 31 is achieved by dip coating, spray coating, or beads coating.

The proper thickness of the charge generation layer 31 thus formed is in the range of about 0.01 to 5 μm, preferably in the range of 0.05 to 2 μm.

The charge transport layer 33 will now be explained in detail.

The charge transport layer 33 works to transport optical carriers which are selectively generated when the charge generation layer is subjected to the light image exposure, thereby forming latent electrostatic images on the surface of the photoconductor. The charge transport layer 33 may comprise the same low-molecular charge transport material as mentioned in the charge generation layer 31 and a binder resin. Alternatively, the charge transport layer 33 may comprise as the main component a high-molecular charge transport material. In any case, the charge transport material, optionally in combination with the binder resin, may be dissolved or dispersed in a proper solvent to prepare a coating liquid for charge transport layer 33. The coating liquid thus prepared may be coated and dried.

Examples of the binder resin that can be used in combination with the low-molecular charge transport material in the charge transport layer 33 include polycarbonate (bisphenol A type and bisphenol Z type), polyester, methacrylic resin, acrylic resin, polyethylene, vinyl chloride, vinyl acetate, polystyrene, phenolic resin, epoxy resin, polyurethane, poly(vinylidene chloride), alkyd resin, silicone raisin, poly(vinylcarbazole), poly(vinyl butyral), poly (vinyl formal), polyacrylate, polyacrylamide, and phenoxy resin. Those binder resins may be used alone or in combination.

Examples of the above-mentioned high-molecular weight charge transport material for use in the charge transport layer 33 are as follows:

(a) Polymer having carbazole ring at the main chain and/or side chain: poly-N-vinylcarbazole, and compounds disclosed in Japanese Laid-Open Patent Applications 50-82056, 54-9632, 54-11737, and 4-183719.

(b) Polymer having hydrazone structure on the main chain and/or side chain: compounds disclosed in Japanese Laid-Open Patent Applications 57-78402 and 3-50555.

(c) Polysilylene: compounds disclosed in Japanese Laid-Open Patent Applications 63-285552, 5-19497, and 5-70595.

(d) Polymer having tertiary amine structure on the main chain and/or side chain: N,N-bis(4-methylphenyl)-4-aminopolystyrene, and compounds disclosed in Japanese Laid-Open Patent Applications 1-13061, 1-19049, 1-1728, 1-105260, 2-167335, 5-66598, and 5-40350.

(e) Other polymers: nitropyrene-formaldehyde condensation polymer, and compounds disclosed in Japanese Laid-Open Patent Applications 51-73888 and 56-150749.

The high-molecular weight charge transport material for use in the present invention is not limited to the above-mentioned polymers. There can be employed various copolymers, block polymers, graft: polymers, and star polymers, each comprising any of the conventional monomers. In addition, crosslinked polymers having an electron donating group, for example, as disclosed in Japanese Laid-Open Patent Application 3-109406, are also usable.

When the charge transport layer 33 comprises as the main component any of the high-molecular weight charge transport material, the charge transport layer 33 may further comprise a proper binder resin and a low-molecular charge transport material. In this case, the same low-molecular charge transport material as described in the charge generation layer, and the above-mentioned binder resin that can be used in combination with the low-molecular charge transport material are usable.

It is preferable that the thickness of the charge transport layer 33 be in the range of about 5 to 100 $\mu$m, more preferably in the range of about 10 to 40 $\mu$m.

Furthermore, the charge transport layer 33 may further comprise a plasticizer and a leveling agent.

Any plasticizer used for general resins, such as dibutyl phthalate or dioctyl phthalate may be added to the charge transport layer coating liquid as it is. In this case, it is proper that the amount of plasticizer be in the range of 0 to about 30 parts by weight with respect to 100 parts by weight of the binder resin for use in the charge transport layer 33.

As the leveling agent for use in the charge transport layer coating liquid, there can be employed silicone oils such as dimethyl silicone oil, and methylphenyl silicone oil, and polymers and oligomers having a perfluoroalkyl group on the side chain thereof. The proper amount of leveling agent is in the range of 0 to about one part by weight with respect to 100 parts by weight of the binder resin for use in the charge transport layer 33.

The photoconductive layer with a single-layered structure will now be described in detail with reference to FIG. 8.

When the single-layered photoconductive layer 23 is provided by the casting method, a function-separating photoconductive layer which comprises a charge generation material and a charge transport material is preferably employed. Any of the above-mentioned charge generation materials and charge transport materials are usable.

The single-layered photoconductive layer 23 may further comprise the above-mentioned plasticizer and leveling agent.

As the binder resin for use in the single-layered photoconductive layer 23, the same binder resin as mentioned in the charge transport layer 33 may be used alone, or in combination with the same binder resin as mentioned in the charge generation layer 31. It is preferable that the single-layered photoconductive layer 23 be in the range of about 5 to 100 $\mu$m, more preferably in the range of about 10 to 40 $\mu$m.

In the electrophotographic photoconductor according to the present invention, the undercoat layer 25 may be interposed between the electroconductive support 21 and the photoconductive layer 23, as shown in FIG. 8, or between the electroconductive support 21 and the charge generation layer 31 in the layered photoconductive layer 23' as shown in FIG. 7 and FIG. 9. The undercoat layer 25 is provided in order to improve the adhesion of the single-layered photoconductive layer 23 (or the charge generation layer 31 of the layered photoconductive layer 23') to the support 21, prevent the occurrence of moiré, improve the coating performance of the photoconductive layer 23 (or the charge generation layer 31), and reduce the residual potential.

The undercoat layer 25 comprises a resin as the main component. The photoconductive layer is provided on the undercoat layer by coating method using a solvent, so that it is desirable that the resin for use in the undercoat layer 25 have high resistance against generally used organic solvents.

Preferable examples of the resin for use in the undercoat layer 25 include water-soluble resins such as polyvinyl alcohol), casein, and sodium polyacrylate; alcohol-soluble resins such as copolymer nylon and methoxymethylated nylon; and hardening resins with three-dimensional network such as polyurethane, melamine resin, alkyd-melamine resin, and epoxy resin.

The undercoat layer 25 may further comprise finely-divided particles of metallic oxides such as titanium oxide, silica, alumina, zirconium oxide, tin oxide, and indium oxide; metallic sulfides; and metallic nitrides.

The undercoat layer 25 can be provided on the electroconductive support 21 by the same coating method as previously mentioned in the description of the photoconductive layer, using an appropriate solvent.

The undercoat layer 25 for use in the present invention may be a metallic oxide layer prepared by the sol-gel processing using a coupling agent such as silane coupling agent, titanium coupling agent, or chromium coupling agent.

Furthermore, to prepare the undercoat layer 25, $Al_2O_3$ may be deposited on the electroconductive support 21 by anodizing process, or an organic material such as poly-para-xylylene (parylene), or inorganic materials such as SiO, $SnO_2$, $TiO_2$, ITO, and $CeO_2$ may be vacuum-deposited on the electroconductive support 21.

It is preferable that the thickness of the undercoat layer 25 be in the range of 0 to 5 $\mu$m.

The photoconductor of the present invention may comprise a protective layer 34 as shown in FIG. 9 in order to protect the photoconductive layer.

The protective layer comprises a resin. Examples of such a resin for use in the protective layer 34 are ABS resin, ACS resin, copolymer of olefin and vinyl monomers, chlorinated polyether, allyl resin, phenolic resin, polyacetal, polyamide, polyamideimide, polyacrylate, polyallyl sulfone, polybutylene, polybutylene terephthalate, polycarbonate, polyether sulfone, polyethylene, poly(ethylene terephthalate), polyimide, acrylic resin, polymethyl pentene, polypropylene, polyphenylene oxide, polysulfone, polystyrene, AS resin, butadiene-styrene copolymer, polyurethane, poly(vinyl chloride), poly(vinylidene chloride), and epoxy resin.

To improve the abrasion resistance, the protective layer 34 may further comprise a fluorine-containing resin, such as polytetrafluoroethylene, and a silicone resin, with an inorganic filler such as titanium oxide, tin oxide, potassium titanate or silica, and an organic filler being dispersed therein where necessary.

The protective layer 34 can be provided by any of the conventional coating methods. It is preferable that the thickness of the protective layer 34 be in the range of about 0.1 to 10 $\mu$m. Furthermore, the conventional material such as a-C or a-SiC may be vacuum-deposited on the photoconductive layer to prepare a protective layer 34.

The protective layer 34 may further comprise a charge transport material. In this case, the previously mentioned positive hole transport materials and electron transport materials are usable.

In the electrophotographic photoconductor of the present invention, an antioxidant may be contained in any layer that contains an organic material therein in order to improve the environmental resistance, to be more specific, to prevent the decrease of photosensitivity and the increase of residual potential. In particular, satisfactory results can be obtained when the antioxidant is added to the layer which comprises the charge transport material.

Examples of the antioxidants for use in the present invention are as follows:

(1) Monophenol Compounds 2,6-di-t-butyl-p-cresol, butylated hydroxyanisole, 2,6-di-t-butyl-4-ethylphenol, and stearyl-β-(3,5-di-t-butyl-4-hydroxyphenyl)propionate.

(2) Bisphenol Compounds 2,2'-methylene-bis-(4-methyl-6-t-butylphenol), 2,2'-methylene-bis-(4-ethyl-6-t-butylphenol), 4,4'-thiobis-(3-methyl-6-t-butylphenol), and 4,4'-butylidenebis-(3-methyl-6-t-butylphenol).

(3) Polymeric Phenol Compounds 1,1,3-tris-(2-methyl-4-hydroxy-5-t-butylphenyl)-butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, and tocopherol.

(4) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

(5) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

(6) Organic Sulfur-containing Compounds

Dilauryl-3,3'-thiodipropionate, distearyl-3,3'-thiodipropionate, and ditetradecyl-3,3'-thiodipropionate.

(7) Organic Phosphorus-containing Compounds

Triphenylphosphine, tri(nonylphenyl)phosphine, tri(dinonylphenyl)phosphine, tricresylphosphine, and tri(2,4-dibutylphenoxy)phosphine.

The commercially available antioxidants for rubbers, plastic materials, and fats and oils are usable as the above-mentioned compounds (1) to (7).

It is preferable that the amount of antioxidant be in the range of 0.1 to 100 parts by weight, more preferably, in the range of 2 to 10 parts by weight, to 100 parts by weight of the charge transport material.

Other features of this invention will become apparent in the course of the following description of exemplary embodiments; which are given for illustration of the invention and are not intended to be limiting thereof.

Preparation Example 1

Fabrication of Electrophotographic Photoconductors

Preparation of Electroconductive Supports

Six kinds of electroconductive supports (1) to (6) for use in the electrophotographic drum-shaped photoconductor were produced as shown in TABLE 1. An aluminum tube with a diameter of 30 mm manufactured by cold extrusion was subjected to cutting to have a predetermined cutting pitch, whereby the electroconductive supports (2) to (6) were obtained. The electroconductive support (1) was not subjected to the cutting. TABLE 1 also shows the surface roughness of each of the obtained electroconductive supports in terms of ten-point mean roughness (Rz) as defined in accordance with JIS B 0601. The cutting pitch and the suface roughness were measured using a commercially available measuring instrument "Surfcom" (Trademark), made by Tokyo Seimitsu Co., Ltd.

TABLE 1

| Electro-conductive Support | Cutting | Cutting Pitch ($\mu$m) | Surface Roughness Rz ($\mu$m) |
|---|---|---|---|
| (1) | not subjected | — | 0.2 |
| (2) | subjected | 5 | 0.2 |
| (3) | subjected | 10 | 0.25 |
| (4) | subjected | 100 | 0.40 |
| (5) | subjected | 500 | 0.55 |
| (6) | subjected | 1000 (=1 mm) | 0.6 |

Using each of the above-mentioned electroconductive supports, six kinds of electrophotographic photoconductors No. 1-(1) to No. 1-(6) were fabricated in the following manner.

Formation of Undercoat Layer

A coating liquid with the following formulation was coated on the outer surface of each of the electroconductive supports, and dried. Thus, an undercoat layer with a thickness of about 3.5 $\mu$m was provided on the electroconductive support.

| | Parts by Weight |
|---|---|
| Alkyd resin (Trademark "Beckosol 1307-60-EL", made by Dainippon Ink & Chemicals, Incorporated) | 6 |
| Melamine resin (Trademark "Super Beckamine G-821-60", made by Dainippon Ink & Chemicals, Incorporated) | 4 |
| Titanium oxide | 40 |
| Methyl ethyl ketone | 200 |

Formation of Charge Generation Layer

A coating liquid with the following formulation was coated on the above prepared undercoat layer, and dried. Thus, a charge generation layer with a thickness of about 0.2 μm was provided on the undercoat layer.

| | Parts by Weight |
|---|---|
| Trisazo pigment of the following formula: | 2.5 |
| Poly(vinyl butyral) (Trademark "XYHL", made by Union Carbide Japan K.K.) | 0.25 |
| Cyclohexanone | 200 |
| Methyl ethyl ketone | 80 |

Formation of Charge Transport Layer

A coating liquid with the following formulation was coated on the above prepared charge generation layer, and dried. Thus, a charge transport layer with a thickness of about 25 μm was provided on the charge generation layer.

| | Parts by Weight |
|---|---|
| Bisphenol A type polycarbonate Trademark "Panlite K1300", made by TEIJIN CHEMICALS Ltd.) | 10 |
| Low-molecular charge transport material of the following formula: | 10 |

-continued

| | Parts by Weight |
|---|---|
| | |
| Methylene chloride | 100 |

Thus, electrophotographic photoconductors No. 1-(1) to No. 1-(6) were fabricated.

Preparation Example 2

The procedure for fabrication of the electrophotographic photoconductors Nos. 1-(1) to 1-(6) in Preparation Example 1 was separately repeated except that the formulation for the charge generation layer coating liquid was changed to the following formulation:

| | Parts by Weight |
|---|---|
| Y-type oxotitanyl phthalocyanine pigment | 2 |
| Poly(vinyl butyral) "S-Lec BM-S" (Trademark) made by Sekisui Chemical Co., Ltd. | 0.2 |
| Tetrahydrofuran | 50 |

Thus, electrophotographic photoconductors No. 2-(1) to No. 2-(6) were fabricated.

EXAMPLE 1

A commercially available digital copying machine (Trademark "imagio MF200", made by Ricoh Company, Ltd.) was modified in such a way that the photoconductor drum No. 1-(1) fabricated Preparation Example 1 was incorporated therein, and a roll-shaped cleaning brush 113, as shown in FIG. 5, capable of working as both the cleaning means and the lubricant applying means was provided so as to apply zinc stearate serving as a lubricating material to the surface of the photoconductor drum via the cleaning brush.

The bite of the cleaning brush into the photoconductor drum and the difference between the circumferential speed of the cleaning brush and that of the photoconductor were adjusted to obtain the following parameters of the adjacent band-shaped lubricating material (zinc stearate) applied areas as represented by the above-mentioned formula (1).

B=200 μm

A1+A2=300 μm

The above-mentioned parameters were measured at ten points on the surface of the photoconductor drum using a commercially available X-ray photoelectron spectroscope "PHI model 1600S" made by Physical Electronics Co., Ltd., using MgKα as the X-ray source, thereby obtaining average values.

In the electrophotographic process, the charging potential (VD) of the photoconductor was set to 850 V, and the potential (VL) after light exposure was set to 120 V.

Then, an image formation test was performed by continuously making 200,000 copies. The surface friction coefficient of the photoconducter drum, and the abrasion of the photoconductor drum were measured at the initial stage, and after making of 100,000 copies and 200,000 copies.

In terms of the density of a solid image portion, the reproducibility of thin lines, and occurrence of abnormal images, the image quality of the copied images was totally evaluated on the following scale:

◎: excellent.

○: good.

Δ1: slight decrease in image density.

Δ2: slight occurrence of image blurring.

X1: conspicuous decrease in image density.

X2: abnormal black stripes and toner deposition on background.

X3: conspicuous image blurring.

The surface friction coefficient ($\mu$s) of the photoconductor drum was measured by the Euler belt method.

The abrasion (Δd) of the photoconductor drum was obtained by subtracting the thickness of the photoconductive layer obtained after making of copies from the initial thickness thereof.

The results are shown in TABLE 2.

Figure 10:
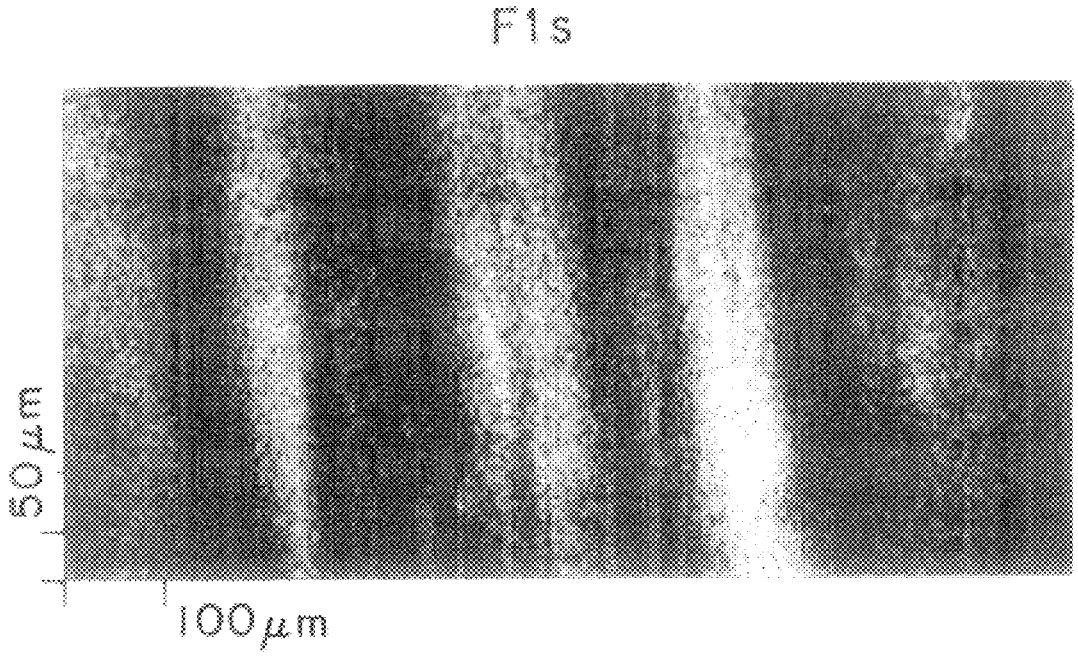
FIG. 10 shows the result of X-ray photoelectron spectroscopic analysis of the state where polytetrafluoroethylene (PTFE) serving as a lubricating material is deposited on the surface of an electrophotographic photoconductor according to the present invention.

After completion, of the image formation test in Example 1, it was confirmed by the XPS method that the lubricating material (zinc stearate) was retained on the surface of the photoconductor drum No. 1-(1) in such a fashion that a plurality of bands spaced therebetween extended in the direction perpendicular to the shaft of rotation of the photoconductor drum, as shown in FIG. 10.

EXAMPLE 2

The procedure for the image formation test as in Example 1 was repeated except that the photoconductor drum No. 1-(1) incorporated in the digital copying machine in Example 1 was replaced by the photoconductor drum No. 2-(1) fabricated in Preparation Example 2.

The evaluation results of the image formation test are shown in TABLE 2.

EXAMPLE 3

The procedure for the image formation test as in Example 1 was repeated except that zinc stearate used as the lubricating material in Example 1 was replaced by polytetrafluoroethylene (PTFE).

The evaluation results of the image formation test are shown in TABLE 2.

EXAMPLE 4

The procedure for the image formation test as in Example 3 was repeated except that the photoconductor drum No. 1-(1) incorporated in the digital copying machine in Example 3 was replaced by the photoconductor drum No. 2-(1).

The evaluation results of the image formation test are shown in TABLE 2.

Comparative Example 1

The procedure for the image formation test as in Example 1 was repeated except that the commercially available digital copying machine (Trademark "imagio MF200", made by Ricoh Company, Ltd.) was modified by providing a lubricant supplying member 117 as shown in FIG. 6 so as to come in direct contact with the surface of the photoconductor drum No. 1-(1) and apply polytetrafluoroethylene (PTFE) thereto.

Although the contact pressure between the lubricant supplying member 117 and the photoconductor drum No. 1-(1) was adjusted, the lubricating material (PTFE) was uniformly coated on the whole surface of the photoconductor drum No. 1-(1). As a result, it was impossible to measure the parameters B and A1+A2 as represented by the above-mentioned formula (1).

The evaluation results of the image formation test are shown in TABLE 2.

Comparative Example 2

The procedure for the image formation test as in Comparative Example 1 was repeated except that the photoconductor drum No. 1-(1) incorporated in the digital copying machine in Comparative Example 1 was replaced by the photoconductor drum No. 2-(1).

It was impossible to measure the parameters B and A1+A2 as represented by the above-mentioned formula (1).

The evaluation results of the image formation test are shown in TABLE 2.

EXAMPLE 5

The procedure for the image formation test as in Comparative Example 1 was repeated except that the photoconductor drum No. 1-(1) incorporated in the digital copying machine in Comparative Example 1 was replaced by the photoconductor drum No. 2-(3), and that the pressure contact between the lubricant supplying member 117 and the photoconductor drum No. 2-(3) was adjusted to obtain the parameters B and A1+A2 as shown below:

B=10 $\mu$m

A1+A2=1.5 $\mu$m

The evaluation results of the image formation test are shown in TABLE 2.

EXAMPLE 6

The procedure for the Image formation test as in Example 5 was repeated except that the pressure contact between the lubricant supplying member 117 and the photoconductor drum No. 2-(3) was adjusted to obtain the parameters B and A1+A2 as shown below:

B=10 $\mu$m

A1+A2=10 $\mu$m

The evaluation results of the image formation test are shown in TABLE 2.

EXAMPLE 7

The procedure for the image formation test as in Comparative Example 1 was repeated except that the pressure contact between the lubricant supplying member 117 and the photoconductor drum No. 2-(3) was adjusted to obtain the parameters B and A1+A2 as shown below:

B=10 $\mu$m

A1+A2=18 $\mu$m

The evaluation results of the image formation test are shown in TABLE 2.

EXAMPLE 8

The procedure for the image formation test as in Example 7 was repeated except that the photoconductor drum No.

2-(3) incorporated in the digital copying machine in Example 7 was replaced by the photoconductor drum No. 2-(4), and that the pressure contact between the lubricant supplying member 117 and the photoconductor drum No. 2-(4) was adjusted to obtain the parameters B and A1+A2 as shown below:

B=100 μm

A1+A2=12 μm

The evaluation results of the image formation test are shown in TABLE 2.

EXAMPLE 9

The procedure for the image formation test as in Example 8 was repeated except that the pressure contact between the lubricant supplying member 117 and the photoconductor drum No. 2-(4) was adjusted to obtain the parameters B and A1+A2 as shown below:

B=100 μm

A1+A2=80 μm

The evaluation results of the image formation test are shown in TABLE 2.

EXAMPLE 10

The procedure for the image formation test as in Example 8 was repeated except that the pressure contact between the lubricant supplying member 117 and the photoconductor drum No. 2-(4) was adjusted to obtain the parameters B and A1+A2 as shown below:

B=100 μm

A1+A2=180 μm

The evaluation results of the image formation test are shown in TABLE 2.

EXAMPLE 11

The procedure for the image formation test as in Example 10 was repeated except that the photoconductor drum No. 2-(4) incorporated in the digital copying machine in Example 10 was replaced by the photoconductor drum No. 2-(5), and that the pressure contact between the lubricant supplying member 117 and the photoconductor drum No. 2-(5) was adjusted to obtain the parameters B and A1+A2 as shown below:

B=500 μm

A1+A2=55 μm

The evaluation results of the image formation test are shown in TABLE 2.

EXAMPLE 12

The procedure for the image formation test as in Example 11 was repeated except that the pressure contact between the lubricant supplying member 117 and the photoconductor drum No. 2-(5) was adjusted to obtain the parameters B and A1+A2 as shown below:

B=500 μm

A1+A2=550 μm

The evaluation results of the image formation test are shown in TABLE 2.

EXAMPLE 13

The procedure for the image formation test as in Example 11 was repeated except that the pressure contact between the lubricant supplying member 117 and the photoconductor drum No. 2-(5) was adjusted to obtain the parameters B and A1+A2 as shown below:

B=500 μm

A1+A2=960 μm.

The evaluation results of the image formation test are shown in TABLE 2.

EXAMPLE 14

The procedure for the image formation test as in Example 13 was repeated except that the photoconductor drum No. 2-(5) incorporated in the digital copying machine in Example 13 was replaced by the photoconductor drum No. 2-(2), and that the pressure contact between the lubricant supplying member 117 and the photoconductor drum No. 2-(2) was adjusted to obtain the parameters B and A1+A2 as shown below:

B=5 μm

A1+A2=0.4 μm

The evaluation results of the image formation test are shown in TABLE 2.

EXAMPLE 15

The procedure for the image formation test as in Example 13 was repeated except that the photoconductor drum No. 2-(5) incorporated in the digital copying machine in Example 13 was replaced by the photoconductor drum No. 2-(3), and that the pressure contact between the lubricant supplying member 117 and the photoconductor drum No. 2-(3) was adjusted to obtain the parameters B and A1+A2 as shown below:

B=10 μm

A1+A2=0.8 μm

The evaluation results of the image formation test are shown in TABLE 2.

EXAMPLE 16

The procedure for the image formation test as in Example 13 was repeated except that the photoconductor drum No. 2-(5) incorporated in the digital copying machine in Example 13 was replaced by the photoconductor drum No. 2-(4), and that the pressure contact between the lubricant supplying member 117 and the photoconductor drum No. 2-(4) was adjusted to obtain the parameters B and A1+A2 as shown below:

B=100 μm

A1+A2=7 μm

The evaluation results of the image formation test are shown in TABLE 2.

EXAMPLE 17

The procedure for the image formation test as in Example 13 was repeated except that: the pressure contact between the lubricant supplying member 117 and the photoconductor drum No. 2-(5) was adjusted to obtain the parameters B and A1+A2 as shown below:

B=500 μm

A1+A2=45 μm

The evaluation results of the image formation test are shown in TABLE 2.

EXAMPLE 18

The procedure for the image formation test as in Example 13 was repeated except that the photoconductor drum No. 2-(5) incorporated in the digital copying machine in Example 13 was replaced by the photoconductor drum No. 2-(6), and that the pressure contact between the lubricant supplying member 117 and the photoconductor drum No. 2-(6) was adjusted to obtain the parameters B and A1+A2 as shown below:

B=1000 μm

A1+A2=80 μm

The evaluation results of the image formation test are shown in TABLE 2.

Comparative Example 3

The procedure for the image formation test as in Example 3 was repeated except that the photoconductor drum No. 1-(1) incorporated in the digital copying machine in Example 3 was replaced by the photoconductor drum No. 2-(2), and that the bite of the cleaning brush into the photoconductor drum No. 2-(2) and the difference between the circumferential speed of the cleaning brush and that of the photoconductor drum were adjusted to increase the amount of PTFE applied to the photoconductor drum. As a result, the lubricating material (PTFE) was uniformly coated on the whole surface of the photoconductor drum No. 2-(2). It was impossible to measure the parameter A1+A2 although the parameter B was recognized as 5 μm from the difference in density by the Fls peak mapping.

The evaluation results of the image formation test are shown in TABLE 2.

Comparative Example 4

The procedure for the image formation test as in Comparative Example 3 was repeated except that the photoconductor drum No. 2-(2) incorporated in the digital copying machine in Comparative Example 3 was replaced by the photoconductor drum No. 2-(3), and that the bite of the cleaning brush into the photoconductor drum No. 2-(3) and the difference between the circumferential speed of the cleaning brush and that of the photoconductor drum were adjusted to increase the amount of PTFE applied to the photoconductor drum. As a result, the lubricating material (PTFE) was uniformly coated on the whole surface of the photoconductor drum No. 2-(3). It was impossible to measure the parameter A1+A2 although the parameter B was recognized as 10 μm from the difference in density by the Fls peak mapping.

The evaluation results of the image formation test are shown in TABLE 2.

Comparative Example 5

The procedure for the image formation test as in Comparative Example 3 was repeated except that the photoconductor drum No. 2-(2) incorporated in the digital copying machine in Comparative Example 3 was replaced by the photoconductor drum No. 2-(4), and that the bite of the cleaning brush into the photoconductor drum No. 2-(4) and the difference between the circumferential speed of the cleaning brush and that of the photoconductor drum were adjusted to increase the amount of PTFE applied to the photoconductor drum. As a result, the lubricating material (PTFE) was uniformly coated on the whole surface of the photoconductor drum No. 2-(4). It was impossible to measure the parameter A1+A2 although the parameter B was recognized as 100 μm from the difference in density by the Fls peak mapping.

The evaluation results of the image formation test are shown in TABLE 2.

Comparative Example 6

The procedure for the image formation test as in Comparative Example 3 was repeated except that the photoconductor drum No. 2-(2) incorporated in the digital copying machine in Comparative Example 3 was replaced by the photoconductor drum No. 2-(5), and that the bite of the cleaning brush into the photoconductor drum No. 2-(5) and the difference between the circumferential speed of the cleaning brush and that of the photoconductor drum were adjusted to increase the amount of PTFE applied to the photoconductor drum. As a result, the lubricating material (PTFE) was uniformly coated on the whole surface of the photoconductor drum No. 2-(5). It was impossible to measure the parameter A1+A2 although the parameter B was recognized as 500 μm from the difference in density by the Fls peak mapping.

The evaluation results of the image formation test are shown in TABLE 2.

Comparative Example 7

The procedure for the image formation test as in Comparative Example 3 was repeated except that the photoconductor drum No. 2-(2) incorporated in the digital copying machine in Comparative Example 3 was replaced by the photoconductor drum No. 2-(6), and that the bite of the cleaning brush into the photoconductor drum No. 2-(6) and the difference between the circumferential speed of the cleaning brush and that of the photoconductor drum were adjusted to increase the amount of PTFE applied to the photoconductor drum. As a result, the lubricating material (PTFE) was uniformly coated on the whole surface of the photoconductor drum No. 2-(6). It was impossible to measure the parameter A1+A2 although the parameter B was recognized as 1000 μm from the difference in density by the Fls peak mapping.

The evaluation results of the image formation test are shown in TABLE 2.

EXAMPLE 19

The procedure for the image formation test as in Example 18 was repeated except that the photoconductor drum No. 2-(6) incorporated in the digital copying machine in Example 18 was replaced by the photoconductor drum No. 2-(2), and that the pressure contact between the lubricant supplying member 117 and the photoconductor drum No. 2-(2) was adjusted to obtain the parameters B and A1+A2 as shown below:

B=5 μm

A1+A2=5 μm

The evaluation results of the image formation test are shown in TABLE 2.

EXAMPLE 20

The procedure for the image formation test as in Example 19 was repeated except that: the photoconductor drum No. 2-(2) incorporated in the digital copying machine in Example 19 was replaced by the photoconductor drum No. 2-(6), and that the pressure contact between the lubricant supplying member 117 and the photoconductor drum No. 2-(6) was adjusted to obtain the parameters B and A1+A2 as shown below:

B=1000 $\mu$m

A1+A2=1000 $\mu$m

The evaluation results of the image formation test are shown in TABLE 2.

Comparative Example 8

The procedure for the image formation test as in Example 1 was repeated except that the photoconductor drum No. 2-(4) was incorporated in the commercially available digital copying machine (Trademark "imagio MF200", made by Ricoh Company, Ltd.) which was not modified. Namely, there was no lubricant applying means in the copying machine.

The evaluation results of the image formation test are shown in TABLE 2.

TABLE 2

| | Photo-conductor | Parameters of Formula (1) | | Lubricating | Image Formation Test | | | | | | | | |
|---|---|---|---|---|---|---|---|---|---|---|---|---|---|
| | | | | | Initial stage | | | After making of 100,000 copies | | | After making of 200,000 copies | | |
| | | B ($\mu$m) | A1 + A2 ($\mu$m) | Material | CF (*) | Δd ($\mu$m) | IQ (**) | CF (*) | Δd ($\mu$m) | IQ (**) | CF (*) | Δd ($\mu$m) | IQ (**) |
| Ex. 1 | 1-(1) | 200 | 300 | zinc stearate | 0.20 | 0 | ◎ | 0.20 | 1.2 | ◎ | 0.22 | 2.3 | ◎ |
| Ex. 2 | 2-(1) | 200 | 300 | zinc stearate | 0.21 | 0 | ◎ | 0.20 | 1.4 | ◎ | 0.21 | 3.0 | ◎ |
| Ex. 3 | 1-(1) | 200 | 300 | PTFE | 0.22 | 0 | ◎ | 0.23 | 1.0 | ◎ | 0.25 | 2.1 | ◎ |
| Ex. 4 | 2-(1) | 200 | 300 | PTFE | 0.22 | 0 | ◎ | 0.21 | 1.0 | ◎ | 0.25 | 2.0 | ◎ |
| Comp. Ex. 1 | 1-(1) | No pitch | (****) | PTFE | 0.11 | 0 | $X_1$ | 0.11 | 0.3 | $X_1$,$X_3$ | 0.12 | 0 5 | $X_1$, $X_3$ |
| Comp. Ex. 2 | 2-(1) | No | (****) | PTFE | 0.11 | 0 | $X_1$ | 0.12 | 0.2 | $X_1$, $X_3$ | 0.10 | 0.4 | $X_1$, |
| Ex. 5 | 2-(3) | 10 | 1.5 | PTFE | 0.32 | 0 | ◎ | 0.35 | 2.5 | ◎ | 0.34 | 5.2 | ○ |
| Ex. 6 | 2-(3) | 10 | 10 | PTFE | 0.27 | 0 | ◎ | 0.25 | 1.1 | ◎ | 0.25 | 2.1 | ◎ |
| Ex. 7 | 2-(3) | 10 | 18 | PTFE | 0.18 | 0 | ◎ | 0.19 | 0.8 | ◎ | 0.18 | 1.7 | ○ |
| Ex. 8 | 2-(4) | 100 | 12 | PTFE | 0.35 | 0 | ◎ | 0.36 | 2.7 | ◎ | 0.35 | 6.0 | ○ |
| Ex. 9 | 2-(4) | 100 | 80 | PTFE | 0.26 | 0 | ◎ | 0.26 | 1.2 | ◎ | 0.27 | 2.5 | ◎ |
| Ex. 10 | 2-(4) | 100 | 180 | PTFE | 0.19 | 0 | ◎ | 0.18 | 0.8 | ◎ | 0.19 | 1.8 | ○ |
| Ex. 11 | 2-(5) | 500 | 55 | PTFE | 0.35 | 0 | ◎ | 0.37 | 3.0 | ◎ | 0.36 | 6.2 | ○ |
| Ex. 12 | 2-(5) | 500 | 550 | PTFE | 0.25 | 0 | ◎ | 0.25 | 1.2 | ◎ | 0.26 | 2.5 | ◎ |
| Ex. 13 | 2-(5) | 500 | 960 | PTFE | 0.18 | 0 | ◎ | 0.18 | 0.9 | ◎ | 0.19 | 2.0 | ○ |
| Ex. 14 | 2-(2) | 5 | 0.4 | PTFE | 0.45 | 0 | ◎ | 0.46 | 8.2 | ○ | 0.50 | 16.5 | $\Delta_1$ |
| Ex. 15 | 2-(3) | 10 | 0.8 | PTFE | 0.43 | 0 | ◎ | 0.45 | 8.5 | ○ | 0.48 | 17.0 | $\Delta_1$ |
| Ex. 16 | 2-(4) | 100 | 7 | PTFE | 0.44 | 0 | ◎ | 0.45 | 8.2 | ○ | 0.50 | 17.0 | $\Delta_1$ |
| Ex. 17 | 2-(5) | 500 | 45 | PTFE | 0.45 | 0 | ◎ | 0.46 | 8.5 | ○ | 0.47 | 16.8 | $\Delta_1$ |
| Ex. 18 | 2-(6) | 1000 | 80 | PTFE | 0.47 | 0 | ◎ | 0.48 | 8.8 | ○ | 0.49 | 17.5 | $\Delta_1$ |
| Comp. Ex. 3 | 2-(2) | 5 | (****) | PTFE | 0.12 | 0 | $X_1$ | 0.11 | 0.3 | $X_1$, $X_3$ | (***) | (***) | (***) |
| Comp. Ex. 4 | 2-(3) | 10 | (****) | PTFE | 0.11 | 0 | $X_1$ | 0.12 | 0.4 | X1, $X_3$ | (***) | (***) | (** |
| Comp. Ex. 5 | 2-(4) | 100 | (****) | PTFE | 0.11 | 0 | $X_1$ | 0.11 | 0.3 | $X_1$, $X_3$ | (***) | (***) | (***) |
| Comp. Ex. 6 | 2-(5) | 500 | (****) | PTFE | 0.12 | 0 | $X_1$ | 0.11 | 0.2 | $X_1$, $X_3$ | (***) | (***) | (***) |
| Comp. Ex. 7 | 2-(6) | 1000 | (****) | PTFE | 0.11 | 0 | $X_1$ | 0.11 | 0.3 | $X_1$, $X_3$ | (***) | (***) | (***) |
| Ex. 19 | 2-(2) | 5 | 5 | PTFE | 0.15 | 0 | $\Delta_1$ | 0.16 | 0.5 | $\Delta_1$ | 0.16 | 0.9 | $\Delta_1$ |
| Ex. 20 | 2-(6) | 1000 | 1000 | PTFE | 0.38 | 0 | ◎ | 0.40 | 7.5 | ○ | 0.41 | 15.2 | $\Delta_1$ |
| Comp. Ex. 8 | 2-(4) | — | — | — | 0.52 | 0 | ◎ | 0.61 | 12.5 | $X_2$ | (***) | (***) | (***) |

(*) "CF" denotes a coefficient of friction.
(**) "IQ" denotes image quality.
(***) The copying test was stopped.
(****) The lubricating material was uniformly coated on the entire surface.

As can be seen from the results shown in TABLE 2, the abrasion wear of the drum-shaped photoconductor according to the present invention can be decreased, and the decrease of image density, that is a side effect as produced by the decrease in surface friction coefficient of the photoconductor can be inhibited. Thus, high quality hard copy images can be obtained for an extended period of time. In other words, the present invention can produce an image forming apparatus with high mechanical durability and high reliability. The effect of the present invention is more noticeable when the parameters of formula (1) are satisfied as previously mentioned.

EXAMPLE 21

Fabrication of Electrophotographic Photoconductor

The procedure for fabrication of the electrophotographic photoconductor drum No. 1-(1) in Preparation Example 1 was repeated except that a coating liquid of protective layer with the following formulation was further coated on the charge transport layer and dried to provide a protective layer with a thickness of about 2 μm on the charge transport layer.

Formulation for Protective Layer

| | Parts by Weight |
|---|---|
| Charge transport material of the following formula: | 2 |
| A type polycarbonate | 4 |
| Methylene chloride | 100 |

Thus, an electrophotographic photoconductor drum No. 3-(1) was fabricated.

Image Formation Test

The procedure for the image formation test as in Example 1 was repeated except that the photoconductor drum No. 1-(1) incorporated in the digital copying machine in Example 1 was replaced by the above-mentioned photoconductor drum No. 3-(1).

The evaluation results of the image formation test are shown in TABLE 3.

EXAMPLE 22

Fabrication of Electrophotographic Photoconductor

The procedure for fabrication of the electrophotographic photoconductor drum No. 1-(1) in Preparation Example 1 was repeated except that a coating liquid of protective layer with the following formulation was further coated on the charge transport layer and dried to provide a protective layer with a thickness of about 2 μm on the charge transport layer.

Formulation for Protective Layer

| | Parts by Weight |
|---|---|
| Charge transport material of the following formula: | 4 |
| A type polycarbonate | 4 |
| Titanium oxide | 1 |
| Methylene chloride | 100 |

Thus, an electrophotographic photoconductor drum No. 4-(1) was fabricated.

Image Formation Test

The procedure for the image formation test as in Example 1 was repeated except that the photoconductor drum No. 1-(1) incorporated in this digital copying machine in Example 1 was replaced by the above-mentioned photoconductor drum No. 4-(1).

The evaluation results of the image formation test are shown in TABLE 3.

TABLE 3

| | Photo-conductor | Initial Stage CF (*) | Initial Stage Δd μm | Initial Stage IQ (**) | After Making of 100,000 Copies CF | After Making of 100,000 Copies Δd μm | After Making of 100,000 Copies IQ | After Making of 200,000 Copies CF | After Making of 200,000 Copies Δd μm | After Making of 200,000 Copies IQ |
|---|---|---|---|---|---|---|---|---|---|---|
| Ex. 1 | 1-(1) | 0.20 | 0 | ◎ | 0.20 | 1.2 | ◎ | 0.22 | 2.3 | ◎ |
| Ex. 21 | 3-(1) | 0.20 | 0 | ◎ | 0.22 | 0.9 | ◎ | 0.23 | 1.8 | ◎ |
| Ex. 22 | 4-(1) | 0.21 | 0 | ◎ | 0.23 | 0.8 | ◎ | 0.25 | 1.5 | ◎ |

Japanese Patent Application No. 11-100773 filed Apr. 8, 1999 is hereby incorporated by reference.

What is claimed is:

1. An electrophotographic drum-shaped photoconductor comprising an electroconductive support and a photoconductive layer formed thereon, with a lubricating material on the surface thereof in the shape of a plurality of bands constituting band-shaped lubricating material applied areas extending along a circumference of said drum-shaped photoconductor in the direction perpendicular or substantially perpendicular to an axis of rotation of said drum-shaped photoconductor, wherein said band-shaped lubricating material applied areas satisfy a dimensional and positional relationship of:

$$B/10<(A1+A2)<2B \quad (1)$$

wherein A1 is the width of one of two adjacent band-shaped lubricating material applied areas, A2 is the width of the other band-shaped lubricating material applied area, B is the distance between the center lines of said two adjacent band-shaped lubricating material applied areas in the direction of said circumference of said drum-shaped photoconductor and B is between 10 μm 500 μm.

2. The electrophotographic drum-shaped photoconductor as claimed in claim 1, wherein said lubricating material is in the form of a solid.

3. The electrophotographic drum-shaped photoconductor as claimed in claim 2, wherein said lubricating material comprises a fluorine-containing resin.

4. The electrophotographic drum-shaped photoconductor as claimed in claim 3, wherein said fluorine-containing resin comprises polytetrafluoroethylene.

5. The electrophotographic (drum-shaped photoconductor as claimed in claim 1, wherein said lubricating material is in the form of a powder.

6. The electrophotographic drum-shaped photoconductor as claimed in claim 5, wherein said lubricating material comprises zinc stearate.

7. The electrophotographic drum-shaped photoconductor as claimed in claim 1, wherein said surface of said photoconductor shows a coefficient of friction of 0.40 or less when measured by the Euler belt method.

8. The electrophotographic drum-shaped photoconductor as claimed in claim 1, further comprising a protective layer which is overlaid on said photoconductive layer.

9. The electrophotographic drum-shaped photoconductor as claimed in claim 8, wherein said protective layer comprises a filler.

10. The electrophotographic drum-shaped photoconductor as claimed in claim 9, wherein said protective layer further comprises a charge transport material.

11. The electrophotographic drum-shaped photoconductor as claimed in claim 8, wherein said protective layer comprises a charge transport material.

12. An image forming apparatus comprising:

an electrophotographic drum-shaped photoconductor comprising an electroconductive support and a photoconductive layer formed thereon, with a lubricating material on the surface thereof in the shape of a plurality of bands constituting band-shaped lubricating material applied areas extending along a circumference of said drum-shaped photoconductor in the direction perpendicular or substantially perpendicular to an axis of rotation of said drum-shaped photoconductor, means for applying said lubricating material to the surface of said drum-shaped photoconductor, said lubricating material applying means provided anywhere around said drum-shaped photoconductor so as to apply said lubricating material to the surface of said photoconductor in the shape of a plurality of bands constituting band-shaped lubricating material applied areas extending along said circumference of said drum-shaped photoconductor in the direction perpendicular or substantially perpendicular to an axis of rotation of said drum-shaped photoconductor, wherein said band-shaped lubricating material applied areas satisfy a dimensional and positional relationship of:

$$B/10<(A1+A2)<2B \quad (1)$$

wherein A1 is the width of one of two adjacent band-shaped lubricating material applied areas, A2 is the width of the other band-shaped lubricating material applied area, B is the distance between the center lines of said two adjacent band-shaped lubricating material applied areas in the direction of said circumference of said drum-shaped photoconductor and B is between 10 μm and 500 μm, means for uniformly charging said drum-shaped photoconductor, means for exposing said charged photoconductor to light images to form latent electrostatic images thereon, means for developing said latent electrostatic images to visible toner images using a developer, means for transferring said toner images to a transfer member, means for fixing said toner images onto said transfer sheet, and means for cleaning the surface of said drum-shaped photoconductor.

* * * * *